US009675999B1

(12) United States Patent
Lakeman et al.

(10) Patent No.: US 9,675,999 B1
(45) Date of Patent: Jun. 13, 2017

(54) FACILE CHEMICALLY-RESISTANT COATINGS

(71) Applicant: Glasslined Technologies, Inc., Greensboro, GA (US)

(72) Inventors: Robert Davis Lakeman, Eatonton, GA (US); Thomas R. Roberts, Rochester, NY (US)

(73) Assignee: Glasslined Technologies, Inc., Greensboro, GA (US)

( * ) Notice: Subject to any disclaimer, the term of this patent is extended or adjusted under 35 U.S.C. 154(b) by 0 days.

(21) Appl. No.: 14/712,924

(22) Filed: May 15, 2015

Related U.S. Application Data

(60) Provisional application No. 61/993,863, filed on May 15, 2014.

(51) Int. Cl.

| | |
|---|---|
| ***B05D 5/00*** | (2006.01) |
| ***B05D 3/02*** | (2006.01) |
| ***B05D 1/02*** | (2006.01) |
| ***C23C 4/12*** | (2016.01) |
| ***C23C 4/10*** | (2016.01) |
| ***C23C 4/18*** | (2006.01) |
| ***C23C 4/02*** | (2006.01) |
| ***C23D 3/00*** | (2006.01) |
| ***C23D 5/04*** | (2006.01) |
| ***C23D 1/00*** | (2006.01) |

(52) U.S. Cl.
CPC ..... *B05D 5/005* (2013.01); *B05D 1/02* (2013.01); *B05D 3/0281* (2013.01); *C23C 4/02* (2013.01); *C23C 4/105* (2013.01); *C23C 4/124* (2013.01); *C23C 4/18* (2013.01); *C23D 1/00* (2013.01); *C23D 3/00* (2013.01); *C23D 5/04* (2013.01)

(58) Field of Classification Search
None
See application file for complete search history.

(56) References Cited

U.S. PATENT DOCUMENTS

| | | | | |
|---|---|---|---|---|
| 2,563,502 | A | 8/1951 | Sweo | |
| 2,572,702 | A | 10/1951 | Davis | |
| 2,588,734 | A | 3/1952 | Kolodney | |
| 2,848,566 | A | 9/1958 | Limpel | |
| 3,051,589 | A | 8/1962 | Sanford | |
| 3,484,266 | A | 12/1969 | Nelson | |
| 4,180,482 | A | 12/1979 | Nishino et al. | |
| 4,282,006 | A | 8/1981 | Funk | |
| 4,407,868 | A | 10/1983 | Iizawa | |
| 4,594,106 | A | 6/1986 | Tanaka | |
| 4,900,703 | A * | 2/1990 | Ono | B01J 23/02 264/630 |
| 4,975,391 | A | 12/1990 | Shimizu et al. | |
| 5,053,251 | A | 10/1991 | Hara et al. | |
| 5,120,694 | A | 6/1992 | Dunne | |
| 5,387,439 | A * | 2/1995 | Roberts | C23D 5/02 427/376.2 |
| 5,516,586 | A | 5/1996 | Singer et al. | |
| RE35,625 | E | 10/1997 | Roberts | |
| 5,895,599 | A | 4/1999 | Nivoche | |
| 5,922,399 | A | 7/1999 | Kobayashi | |
| 5,924,257 | A | 7/1999 | Mussler et al. | |
| 6,177,201 | B1 | 1/2001 | Wallace et al. | |
| 2003/0059600 | A1 | 3/2003 | Gazo et al. | |
| 2011/0070425 | A1 | 3/2011 | Duprez et al. | |
| 2011/0111239 | A1* | 5/2011 | Dandekar | A47J 36/02 428/469 |
| 2012/0282408 | A1 | 11/2012 | Jacob et al. | |
| 2015/0298168 | A1* | 10/2015 | Roberts | C23C 4/11 427/452 |
| 2016/0194764 | A1 | 7/2016 | Patel | |

FOREIGN PATENT DOCUMENTS

| | | | |
|---|---|---|---|
| DE | 4013758 | A1 | 5/1991 |
| WO | 2014085512 | A1 | 6/2014 |
| WO | 2015009540 | A1 | 1/2015 |

OTHER PUBLICATIONS

Written Opinion for PCT/US2013/072113, Mar. 4, 2014 (9 pages).
International Search Report for PCT/US2013/072113, Mar. 4, 2014 (3 pages).
Extended European Search Report for European Patent Application No. 13858750.6 corresponding to PCT/US2013/072113, dated Jun. 20, 2016 (6 pages).
Su Jiancheng et al., "Study on the technology of Flame Spraying Glass Coatings," New Technology & New Process, No. 11, 2003 (3 pages) in Chinese.
Li Yugang, "Repairing Porcelain Enamel Reactor Using Ceramic Coatings," New Technology & New Process, 1995 (2 pages) in Chinese.
Translation of First Office Action in Chinese Patent Application No. 201380070926.1, dated Oct. 31, 2016 (19 pages).

(Continued)

*Primary Examiner* — Michael P Rodriguez
(74) *Attorney, Agent, or Firm* — Thrive IP®; Jeremy M. Stipkala

(57) ABSTRACT

The present invention provides methods for preparing or repairing a chemically-resistant coating such as a porcelain enamel on a metal substrate. One such method involves forming a ground coat on the substrate, cooling the substrate to substantially near ambient temperature, optionally by applying a heat source to cool the substrate slowly, followed by flame-spray depositing a coating material onto the softened ground coat. Then, the substrate is allowed to cool slowly so the chemically-resistant coating can form with less stress. Optionally, an induction coil is used to heat the substrate, both to form the ground coat and to slow the cooling of the substrate. Such methods allow for easier and faster repairs, and even in situ repairs of articles such as chemical reactor vessels, covers, baffles, thermowells, agitators, agitator shafts, pipes, heat exchangers, and storage tanks, as well as white goods such as ovens, stoves, washing machines, driers, in addition to bathtubs, sinks, and shower stalls, in addition to steel girders and steel reinforcing bars. Articles having a chemically-resistant coating also form a part of the invention.

19 Claims, No Drawings

(56) References Cited

OTHER PUBLICATIONS

Yan Kangping et al., "Corrosion and Protection of Process Equipment," 2nd Edition, Chemical Industry Press, Aug. 31, 2009 (4 pages) in Chinese.

Office Action, dated Sep. 28, 2016, for U.S. Appl. No. 14/646,221 (25 pages).

Certified English Translation of Su Jiancheng et al., "Study on the Technology of Flame Spraying Glass Coatings," New Technology & New Process, No. 11, 2003 (6 pages).

Certified English Translation of Li Yugang, "Repairing Porcelain Enamel Reactor Using Ceramic Coatings," New Technology & New Process, 1995 (4 pages).

"Introduction to Thermal Spray Processing," as published in Handbook of Thermal Spray Technology, J.R. Davis, Ed., (2004) (1 page).

Final Office Action in U.S. Appl. No. 14/646,221 dated Mar. 14, 2017 (23 pages).

* cited by examiner

FACILE CHEMICALLY-RESISTANT COATINGS

RELATED APPLICATIONS

This application claims benefit of priority under 35 U.S.C. 119(e) to U.S. Provisional Application No. 61/993,863, filed on May 15, 2014, and entitled, "FACILE CHEMICALLY-RESISTANT COATINGS," which is incorporated herein by reference in its entirety.

FIELD OF INVENTION

This invention relates to methods for preparing and repairing chemically-resistant coatings, such as those known as porcelain enamels and vitreous enamels. This invention also relates to articles having a chemically-resistant coating.

BACKGROUND OF THE INVENTION

It is known, for example from U.S. Pat. No. 5,387,439, to manufacture porcelain enamel coatings on steel substrates. The '439 patent addresses a known problem of such coatings: they generally have poor impact strength. Thus, when tools, hardware, debris, or other material forcefully contacts the coating, or the article is subject to rough handling, the coating may be damaged. If a damaged coating encounters a harsh chemical environment such as is present in a chemical manufacturing process, the underlying steel substrate could be etched, and the process would be contaminated by the etched steel. Moreover, the steel substrate ultimately would fail, and the chemical process would no longer be contained or protected from the ambient conditions outside of the steel. The '439 patent discloses coatings having improved impact strength due to the incorporation of inorganic fibrous material into the coating.

Nonetheless, porcelain enamel coatings are still vulnerable to chipping, cracking, and other mechanical damage. The '439 patent teaches that a damaged coating on a process vessel can be corrected with a complete reglassing of the vessel (col. 2, ll. 38-41), or by the use of a tantalum (metal and/or oxide) plug (col. 8, ll. 14-19). As can be appreciated, reglassing of the entire vessel represents an enormous expense in both repair effort and process downtime, at least because the vessel must be disassembled from the process, typically transported to a repair site that includes a large oven or kiln, reglassed, transported back, and re-assembled into the process. Also, a tantalum patch, usually affixed over the damage site with an epoxy, may alter the chemistry of the process environment. Any repair to glass-lined equipment employing material other than glass is considered temporary.

Other instances of enamel on steel or other metals figure prominently in the economy. So-called white goods, such as washers, dryers, dishwashers, stove tops, ovens, water heaters, and refrigerators, and shower stalls, sinks, and bathtubs also employ sometimes delicate enamel coatings. Each year, manufacturers, distributors, and retailers of such goods must accept a certain loss ratio, because white goods slightly damaged prior to the point of sale are rejected by the consumer. Easy repair of cosmetic damage to such goods would be highly desirable.

Therefore, methods for repairing damage to a porcelain enamel coating resulting in a chemically-resistant coating are desired. Also, methods for repairing such damage that do not require a complete reglassing are also desired. Methods that can be performed in situ or with minimal disassembly are also desired. Furthermore, methods for easily preparing a chemically-resistant coating in the first place are also sought. Methods for repairing a chemically-resistant coating matching the thickness of the existing coating and/or its color are also sought. Articles having a chemically-resistant coating, such as a chemically-resistant coating that is easily repaired, are also desired. The various embodiments of the present invention may meet one or more of those desires, thereby solving the underlying technical problems with current coating manufacturing and repair technology.

SUMMARY OF THE INVENTION

Recently, Applicants' company filed international patent application number PCT/US2013/072113, entitled, "Methods for Preparing and Repairing Chemically-Resistant Coatings," on Nov. 27, 2013, which claims benefit of U.S. Provisional Patent Application No. 61/731,109, also entitled "Methods for Preparing and Repairing Chemically-Resistant Coatings," which was filed on Nov. 29, 2012. Both the '113 international patent application and the '109 U.S. provisional patent application are incorporated herein by reference in their entirety. In those applications, Applicants' company discloses and claims, among other things, methods for preparing a chemically-resistant coating on a substrate having a ground coat thereon, comprising heating the substrate to a first temperature thereby forming a softened ground coat; flame spray depositing a coating material onto the softened ground coat; and cooling the substrate slowly, thereby forming the chemically-resistant coating on the substrate.

Now, unexpectedly, Applicants have found new methods to prepare and repair chemically-resistant coatings. In some embodiments, those methods involve forming a ground coat, cooling the ground coat, and then flame-spray depositing a coating material onto the cooled ground coat, followed by cooling the coating slowly to relieve stress. Those methods can be used to manufacture a chemically-resistant coating in the first place, or to repair a damaged coating, whether or not the original coating was made according to the inventive method. Advantageously, some embodiments of the present invention allow the formation of a new protective chemically-resistant coating on a portion of the substrate that blends well with adjacent pre-existing coating. In further embodiments, the methods can be used to completely glass or reglass an article such as a reactor vessel, a cover for a reactor vessel or other vessel, a baffle, a thermowell, an agitator, an agitator shaft, a pipe, a heat exchanger, a storage tank, or other process equipment as needed. In still other embodiments, methods of the present invention are used to prepare or repair chemically-resistant coatings on white goods such as ovens, stoves, washers, and driers, and bathtubs, sinks, and shower stalls. Still further embodiments relate to preparing or repairing chemically-resistant coatings on structural steel such as steel girders and steel reinforcing bars useful in concrete construction. For example, steel bars can be placed under tension and liquid concrete poured in the conventional manner of constructing steel-reinforced concrete. When the tension is released, the exposed ends of the bars can be treated at the construction site if desired to add an anti-corrosive chemically-resistant coating. Or the entire reinforcing bar can be coated prior to pouring the concrete. Similarly, exposed steel on bridges and roadways can be provided with an anti-corrosive chemically-resistant coating as described herein. Additional embodiments of the present invention include articles containing a chemically-resistant coating made according to the present invention.

Thus, some embodiments of the present invention relate to methods for preparing a chemically-resistant coating on a substrate having a ground coat thereon, the ground coat having an initial temperature substantially near ambient temperature, comprising:

flame-spray depositing a coating material onto the ground coat; optionally heating the substrate; and cooling the substrate slowly, thereby forming the chemically-resistant coating on the substrate. Flame-spray depositing the coating material onto the ground coat will raise the temperature from ambient. In some cases, the substrate is heated to an even higher temperature before cooling slowly.

Other embodiments relate to methods of repairing a chemically-resistant coating on a substrate in need thereof, the substrate having a substrate temperature substantially near ambient temperature, comprising:

applying a composition to a damage site on the substrate, wherein the composition:

(a) comprises a ground coat material in the form of particles having a particle size distribution such that at least about 5 weight percent of the particles are smaller than 44 micrometers and at least about 20 weight percent of the particles are larger than 150 micrometers, and (b) the ground coat material comprises a frit material comprising from about 48 to about 58 weight percent of silica, from about 12 to about 22 weight percent of boric oxide, from about 1 to about 9 weight percent of potassium oxide, and from about 1 to about 9 weight percent of alumina;

firing the composition to form a softened ground coat on the substrate;

allowing the softened ground coat to cool to substantially near ambient temperature, forming a cooled ground coat;

flame-spray depositing a coating material onto the cooled ground coat, wherein the coating material:

(a) is in the form of particles having an average size ranging from about 74 to about 177 micrometers, and (b) comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide; and cooling the substrate slowly, thereby repairing the chemically-resistant coating on the substrate.

Further embodiments relate to methods of preparing a chemically-resistant coating on a substrate, comprising: applying a composition to the substrate, wherein the composition: (a) comprises a ground coat material in the form of particles having a particle size distribution such that at least about 5 weight percent of the particles are smaller than 44 micrometers and at least about 20 weight percent of the particles are larger than 150 micrometers, and (b) the ground coat material comprises a frit material comprising from about 48 to about 58 weight percent of silica, from about 12 to about 22 weight percent of boric oxide, from about 1 to about 9 weight percent of potassium oxide, and from about 1 to about 9 weight percent of alumina;

firing the composition to form a softened ground coat on the substrate;

allowing the softened ground coat to cool to substantially near ambient temperature, forming a cooled ground coat;

flame-spray depositing a coating material onto the cooled ground coat, wherein the coating material:

(a) is in the form of particles having an average size ranging from about 74 to about 177 micrometers, and (b) comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide; and cooling the substrate slowly, thereby preparing the chemically-resistant coating on the substrate.

Additional embodiments relate to articles of manufacture comprising: (a) a metal substrate; (b) a ground coat comprising silica, boric oxide, potassium oxide, and alumina; and (c) a coating in the form of splats comprising silica, alumina, sodium oxide, lithium oxide, and zirconium oxide. Further embodiments additionally comprise (d) a color coat on the coating in the form of splats. Such articles can be reactor vessels, covers, baffles, thermowells, agitators, agitator shafts, pipes, pipelines, heat exchangers, storage tanks, grain silos, and other components useful in the chemical, petrochemical, food, pharmaceutical, plastics, cosmetic, municipal water treatment, and related industries, white goods such as ovens, stoves, stove tops, refrigerators, dishwashers, water heaters, washers, and driers, and bathtubs, sinks, urinals, toilets, and shower stalls, construction material such as steel girders and steel reinforcing bars for concrete commonly known as "rebar," and anywhere a chemically-resistant surface is desirable. Some instances of the present invention provide the ground coat, coating in the form of splats, and optionally the color coat on the interior of the article, while other instances provide those coatings on the exterior of the article, while further instances provide those coatings, which can be alike or different, on both the interior and the exterior of the article.

DETAILED DESCRIPTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

DEFINITIONS

Generally speaking, each word or term used herein should be assigned its ordinary and customary meaning as understood by one of ordinary skill in the relevant art. In the event that there is a plurality of definitions for a term herein, those in this disclosure prevail unless stated otherwise. Occasionally, by explicit definition, the meaning of a word or term has changed. Where ever the phrase "for example," "such as," "including" and the like are used herein, the phrase "and without limitation" is understood to follow unless explicitly stated otherwise. Similarly "an example," "exemplary" and the like are understood to be non-limiting. The term "substantially" allows for deviations from the descriptor that don't negatively impact the intended purpose. Descriptive terms are understood to be modified by the term "substantially" even if the word "substantially" is not explicitly recited. The term "about" when used in connection with a numerical value refers to the actual given value, and to the approximation to such given value that would reasonably be inferred by one of ordinary skill in the art, including approximations due to the experimental and or measurement conditions for such given value. The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Cooling, in general, means cooling from a greater-than-ambient temperature to or toward ambient temperature. Cooling can be controlled, such as by application of thermal energy such as by oven or induction heater. Or cooling can be by exposure to ambient air. Ambient air can be temperature controlled itself, such as inside a work space like a factory. Or ambient air can have the temperature of outside air, perhaps because the workpiece having the substrate to be coated is outside. Substantially near ambient temperature means, in some instances, below the boiling temperature of water under ambient pressure. If ambient pressure is approximately one atmosphere, then "substantially near ambient temperature" means below 212 degrees Fahrenheit, in certain embodiments. Ambient temperature means the surrounding temperature, such as room temperature, or the temperature of the environment surrounding the workpiece. In some cases, the workpiece could be outside, so ambient temperature could range from more than 70 degrees below freezing to above 125 degrees Fahrenheit.

A material containing substantially no suspending agent, or substantially no pigment, or substantially none of another named ingredient or class of ingredient, means the material contains none of that ingredient, or so little of that ingredient that the manufacturing and performance properties are not measurably affected by the presence of the small amount of that ingredient.

The Substrate

As stated above, some embodiments of the present invention provide methods for preparing or repairing a chemically-resistant coating on a substrate. Any suitable substrate can be used, such as, for example, a metal or metal alloy. In some cases, the substrate comprises steel. In one embodiment, the substrate is a cold-rolled low-carbon steel which contains less than 0.25 weight percent of carbon. Thus, as is disclosed in A.S.M.E. Specification SA285, Grade B, or SA285M-82, Grade B, this steel often contains no more than 0.22 weight percent of carbon, no more than 0.9 weight percent of manganese, no more than 0.035 weight percent of phosphorous, no more than 0.04 weight percent of sulfur, and at least about 98 weight percent of iron. In further embodiments, the substrate is a ferrous metal or alloy thereof such as those materials disclosed on pages 23-45 to 23-46 of Robert H. Perry et al.'s "Chemical Engineers' Handbook," Fifth Edition (McGraw-Hill Book Company, New York, 1973). Thus, for example, the substrate may consist essentially of Inconel Alloy 600, Inconel Alloy 610, Inconel Alloy 625, Inconel Alloy 700, Inconel Alloy 702, Inconel Alloy 705, Inconel Alloy 713, Inconel Alloy 721, Inconel Alloy 722, Inconel Alloy X-750, and the like.

Whether the coating is being prepared or repaired on the substrate, the substrate may need to be cleaned and prepared beforehand. Any previous chemically-resistant coating can be removed, in whole or in part. For example, an area surrounding a defect or chip in the coating can be de-enameled, exposing the raw metal. The surface of the substrate often contains many imperfections, especially after it has been fabricated and is being finished or refinished. Thus, it is desired to prepare such surface by mechanical blasting to remove imperfections such as oxides, scales, pits, tool marks, etc.

In one embodiment, it is possible to prepare the surface of the substrate by blasting. As is disclosed on pages 198 to 211 of Andrew I. Andrews' "Porcelain Enamels: The Preparation, Application, and Properties of Enamels," Second Edition (Garrard Press, Champaign, Ill., 1961), one may prepare such surface by mechanical blasting, by compressed air blasting, and the like. One may use conventional abrasives such as sand, steel grit, alumina grit, and the like. In one embodiment, alumina grit with a particle size smaller than 40 mesh is used. Certain embodiments provide cleaning the substrate by sand blasting, grit blasting, or a combination of both. Blasting may be continued until visual inspection reveals that the surface of the substrate has a clean, uniform grey appearance, indicating that it has been cleaned sufficiently to promote adherence between the ground coat and the substrate.

The Ground Coat

The ground coat can be any suitable material. As is known in the art, a ground coat in certain embodiments can be an alkali borosilicate glass composition which is used to develop high adherence between the substrate and subsequent coatings on the substrate. In still further embodiments, a ground coat can contain from about 10 to about 20 weight percent of boric oxide, from about 40 to about 60 weight percent of silica, and from about 15 to about 25 weight percent of alkali metal oxide(s) selected from the group consisting of the oxides of lithium, sodium, potassium, rubidium, cesium, francium, and mixtures thereof.

In one embodiment, ground coat comprises from about 60 to about 65 weight percent of silica. In another embodiment, the ground coat comprises from about 10 to about 22 weight percent of boric oxide. A further embodiment provides a ground coat comprising from about 1 to about 9 weight percent of potassium oxide. An additional embodiment includes a ground coat comprising from about 1 to about 9 weight percent of alumina. Still other embodiments include a ground coat comprising calcium oxide, cobalt oxide, nickel oxide, manganese oxide, one or more alkali metal oxides such as lithium oxide, sodium oxide, rubidium oxide, cesium oxide, francium oxide, or a combination thereof.

A ground coat composition can be prepared in any suitable manner. For example, a mixer can be used. Optionally, a suitable mixer can also comminute, that is, pulverize, or further reduce the particle size of the composition. Or a separate pulverizer can be employed. Thus, in one embodiment, a suitable mixer is a tumbling mill such as, e.g., a tube mill, a compartment mill, a rod mill, a pebble mill, a ball mill, and the like. See, e.g., pages 8-25 to 8-28 of Robert H. Perry et al.'s "Chemical Engineers' Handbook," Fifth Edition (McGraw-Hill Book Company, New York, 1973).

A ground coat composition, which is applied to the substrate and then fired to form a softened ground coat, can take the form of a slurry. In some embodiments, a sufficient amount of liquid is added to the mixer with the solid material so that a slurry containing from about 60 to about 70 weight percent of solid material is formed. That is, the slurry comprises from about 30 to about 40 weight percent liquid. The liquid can include any suitable liquid such as water, lower alcohols such as methanol, ethanol, propanol, or butanol, or combinations of any of the foregoing. Milling of this slurry in a mixer, in certain embodiments, is continued until a substantially homogeneous mixture with a particle size distribution such that at least five weight percent of the particles in the slurry are smaller than 44 micrometers and at least about 20 weight percent of the particles in the slurry are larger than 150 micrometers is produced, in some embodiments. Samples may be periodically removed from the mixer and subjected to particle size analysis to determine whether the slurry has the desired particle size distribution. See, for example, U.S. Pat. No. 4,282,006 for a discussion of the measurement of particle size distribution.

In some cases, a ground coat material can be prepared, for example, by charging into a mixer a glass batch containing from about 48 to about 58 weight percent (by total weight of the glass batch, dry basis) of silica, from about 12 to about 22 weight percent of boric oxide, from about 9 to about 19 weight percent of sodium oxide, from about 1 to about 9 weight percent of potassium oxide, and from about 1 to about 9 weight percent of alumina. In addition, this glass batch also may contain from about 1 to about 6 weight percent of calcium fluoride, from about 0.2 to about 6 weight percent of cobalt oxide, from about 0.2 to about 4 weight percent of nickel oxide, and from about 0.2 to about 3 weight percent of manganese oxide. Optionally, one may also add various suspending agents, electrolytes, and other materials and fluids to the mixer; see, e.g., pages 360-365 of the aforementioned Andrews text.

A ground coat composition may be applied to the substrate via any suitable method, such as, for example, dipping, slushing, spraying, and combinations thereof. Any conventional spraying means may be used; see, e.g., pages 394 to 403 of the aforementioned Andrews reference. It is possible to apply the ground coat composition to the prepared substrate in such a manner that one obtains a uniform thickness after firing of from about 0.25 millimeters to about 0.5 millimeters. To achieve this goal, in general a wet film of from about 0.3 to about 0.75 millimeters can be applied to the substrate.

Once the ground coat composition is applied to the substrate, the composition may be dried if it is in the form of a slurry. Any suitable drying method can be used, including air drying, heated drying, forced air drying, force drying in an oven, and combinations thereof. Moisture content of a dried ground coat composition, in some cases, is less than about 10 weight percent, or less than about 1 weight percent in other cases. Then the ground coat composition is fired at any suitable temperature. Firing the ground coat composition can employ any suitable method, such as, for example, induction heating, placing the workpiece in an oven or kiln, or combinations thereof. Induction heating, comprising placing one or more induction coils in proximity to the substrate, can be employed in certain embodiments of the present invention. The induction coil heats the metal substrate, which in turn heats the ground coat composition. The ground coat composition is heated to a temperature at which it vitrifies. Some embodiments provide the ground coat so formed is heated to or held at a temperature at which the ground coat is softened. Such a temperature can be above the ground coat's glass transition temperature, in certain embodiments. Other embodiments provide a softened ground coat at a temperature at which the ground coat does not significantly flow or deform on the time scale of the manufacturing operation that applies the coating material.

In some embodiments, the optionally-dried ground coat composition on the substrate is subjected to a temperature ranging from about 810 to about 910 degrees Centigrade for a time ranging from about 20 to about 150 minutes. It is possible to subject the dried substrate to a temperature ranging from about 850 to about 880 degrees Centigrade for a time ranging from about 20 to about 150 minutes, in certain embodiments. Still other embodiments provide firing the ground coat composition at a temperature ranging from about 1,500 to about 1,600 degrees Fahrenheit (about 816 to about 871 degrees Centigrade). Still other embodiments involve heating the substrate to a temperature ranging from about 1450 to about 1500 degrees Fahrenheit, and then allowing the substrate to cool to substantially near ambient temperature.

The Coating Material

The coating material that is deposited onto the cooled ground coat to form the chemically-resistant coating can be any suitable material. In some embodiments, the coating material comprises silica, alumina, sodium oxide, lithium oxide, and zirconium oxide. In other embodiments, the coating material comprises from about 68 to about 74 weight percent of silica. Further embodiments provide a coating material comprising from about 0.5 to about 2.5 weight percent of alumina. Additional embodiments include a coating material comprising from about 7 to about 15 weight percent of sodium oxide. Yet other embodiments include a coating material comprising from about 1 to about 5 weight percent of lithium oxide. Still further embodiments provide a coating material comprising from about 2 to about 9 weight percent of zirconium oxide. In one embodiment, the frit contains from about 70 to about 72 weight percent of silica, from about 1 to about 2 weight percent of alumina, from about 11 to about 14 weight percent of sodium oxide, from about 1 to about 3 weight percent of lithium oxide, and from about 2 to about 6 weight percent of zirconium oxide.

The coating material can also contain suspending agents such as montmorillonitic type clays, for example. Some embodiments provide from about 0.1 to about 0.6 weight percent of such suspending agent(s), by weight of solid material. In other embodiments, the coating material contains substantially no suspending agents. Further embodiments provide a mechanical aid, such as a vibrating device on the hopper feeding a flame sprayer, to aid the mixing of a coating material as it is being flame sprayed at a substrate. Any conventional electrolyte (such as potassium chloride, barium chloride, aluminum chloride, calcium chloride, and the like) may be used in the coating material, in additional embodiments, in any suitable amount. In some cases, from about 0.02 to about 0.6 weight percent of such electrolyte (by weight of dry solid material) may be used. In some embodiments, the coating material does not contain any pigments.

The coating material can be prepared in any suitable manner. As explained for the ground coat, the raw ingredients for the coating material can be introduced into a mixer that also comminutes, in some embodiments. Once mixed, the ingredients can be vitrified into a frit, quenched, dried, and then reduced to particles again. In preparation for flame-spray deposition, a particle size of 80-200 mesh can be used in certain embodiments. In other embodiments, a mesh size of 100-200 is used. In still other embodiments, a mesh size of 80-100 is employed. As is known in the art, 80 mesh corresponds to a particle size of about 177 micrometers, 100 mesh corresponds to a particle size of about 149 micrometers, and 200 mesh corresponds to a particle size of about 74 micrometers. In still other embodiments, the coating material is in the form of particles having an average size ranging from about 115 to about 125 micrometers. Further embodiments provide a coating material in the form of particles having an average size ranging from about 50 micrometers to about 100 micrometers, from about 100 micrometers to about 150 micrometers, from about 150 micrometers to about 200 micrometers, from about 200 micrometers to about 250 micrometers, from about 250 micrometers to about 300 micrometers, from about 300 micrometers to about 350 micrometers, or from about 350 micrometers to about 400 micrometers. Still additional embodiments provide a coating material in the form of particles having an average size ranging from about 10 micrometers to about 50 micrometers.

Color Coat Composition

Optionally, a color coat composition is added onto the coating composition. The color coat composition can contain substantially any ingredient or combination of ingredients that the coating composition may contain, as described above. In some embodiments, the color coat composition comprises silica, alumina, sodium oxide, lithium oxide, and zirconium oxide. In other embodiments, the color coat composition comprises from about 68 to about 74 weight percent of silica. Further embodiments provide a color coat composition comprising from about 0.5 to about 2.5 weight percent of alumina. Additional embodiments include a color coat composition comprising from about 7 to about 15 weight percent of sodium oxide. Yet other embodiments include a color coat composition comprising from about 1 to about 5 weight percent of lithium oxide. Still further embodiments provide a color coat composition comprising from about 2 to about 9 weight percent of zirconium oxide. In one embodiment, the frit contains from about 70 to about 72 weight percent of silica, from about 1 to about 2 weight percent of alumina, from about 11 to about 14 weight percent of sodium oxide, from about 1 to about 3 weight percent of lithium oxide, and from about 2 to about 6 weight percent of zirconium oxide.

In some embodiments, the coating composition contains substantially no pigments, and a color coat composition is added onto the coating composition to provide aesthetic aspects such as color. Any suitable pigments can be used, such as, for example, cobalt oxide, black iron oxide, other iron oxides, and combinations thereof. Transition metal oxides suitable as pigments also can be used in the color coat composition. Certain cases provide a color coat composition comprising pigments chosen from those conventionally known except for those imparting red. The particle size distributions of the ingredients of the color coat composition are not limited. In some embodiments, the color coat composition is present in a slurry, and has a particle size distribution such that at least five weight percent of the particles in the slurry are smaller than 44 micrometers and at least about 20 weight percent of the particles in the slurry are larger than 150 micrometers. Such a slurry can be sprayed on the surface of the coating composition already flame sprayed onto the ground coat and substrate. In preparation for adding a color coat onto the coating material, a particle size of 80-200 mesh for the color coat composition can be used in certain embodiments. The color coat may also be hot dusted onto the coating material on the substrate.

Forming the Chemically-Resistant Coating

The substrate of the workpiece can be heated by any suitable method for any purpose requiring heat. In addition, each of heating the substrate, firing, optionally maintaining the temperature of the softened ground coat by heating, allowing the substrate to cool, and cooling the substrate slowly, can be accomplished by the same or different heating methods. In some cases, allowing the substrate to cool simply means having the temperature fall due to contact with a cooler ambient. In other cases, allowing the substrate to cool involves the addition of some thermal energy, so the substrate does not cool as quickly as exposure to ambient would allow. The ground coat in one embodiment can be formed in a kiln or oven. A heat gun can maintain the temperature of the softened ground coat, if necessary, before and during cooling to substantially near ambient temperature. Once the coating composition is flame-spray deposited, an induction coil can be used to apply induction heating to the substrate to allow the substrate to cool slowly, thereby allowing the coating material and the ground coat to relieve any stresses.

Applicant has found that certain embodiments of the present invention afford a previously unavailable degree of freedom. Because of the ease of employing those embodiments, and the robust nature of the resulting chemically-resistant coatings, repairs of damaged coatings in the field are now possible. Some embodiments employ induction heating as the sole or primary heat source. In certain cases, induction heating obviates the need to disassemble, transport, and deglass process equipment that has a damaged porcelain enamel coating. Thus, in one embodiment, heating the substrate comprises applying induction heating. In a further embodiment, forming a cooled ground coat comprises applying induction heating. In another embodiment, cooling the substrate slowly comprises applying induction heating.

Flame-spray deposition of the coating material can occur according to any suitable method. Commercially-available flame spray equipment can be used in some embodiments. The coating material is loaded in the flame sprayer, and then deposited onto the cooled ground coat. Optionally, the flame sprayer is equipped with a vibration device to mix the coating material in the hopper of the flame sprayer. In some cases, the ground coat is maintained at a temperature no greater than about 150 degrees Fahrenheit before the start of flame-spray depositing. In other cases, the ground coat is no more than about 90 degrees Fahrenheit, or no more than about 80 degrees Fahrenheit before beginning flame-spray depositing.

Flame-spray depositing the coating material onto the softened ground coat will cause the coating material to form a layer of "splats" in some embodiments. Upon microscopic inspection of a cross-section of certain chemically-resistant coatings of the present invention, those splats will appear as flattened or deformed spheres characteristic of flame-spray deposition. In some embodiments, the splats have an average volume ranging from about $2.1\times10^{-13}$ $m^3$ to about $2.9\times10^{-12}$ $m^3$. In other embodiments, the splats have an average volume ranging from about $2.1\times10^{-13}$ $m^3$ to about $1.7\times10^{-12}$ $m^3$. In still other embodiments, the splats have an average volume ranging from about $7.9\times10^{-13}$ $m^3$ to about $1.0\times10^{-12}$ $m^3$.

Some embodiments therefore provide a coating material in the form of splats, wherein the splats comprise from about 68 to about 74 weight percent of silica. Other embodiments include splats comprising from about 0.5 to about 2.5 weight percent of alumina. Further embodiments involve splats comprising from about 7 to about 15 weight percent of sodium oxide. Still other embodiments include a coating in the form of splats that comprise from about 1 to about 5 weight percent of lithium oxide. Additional embodiments of the present invention contain splats that comprise from about 2 to about 9 weight percent of zirconium oxide.

The thickness of the layer of coating material can be any suitable dimension. In some embodiments, the thickness of the coating material ranges from about 0.5 to about 1.0 millimeter.

Another aspect of the invention relates to the relief of stress in the chemically-resistant coating. Such stress can appear in the ground coat, in the flame-spray deposited coating material, the color coat layer, another layer of material the skilled artisan has chosen to employ with the foregoing materials, or a combination thereof. Such stress can be relieved, for example, by holding the workpiece or a portion thereof where the chemically-resistant coating is being formed at an elevated temperature. In some cases, that elevated temperature is at or above the glass transition temperature of the ground coat. In other cases, that elevated temperature is at or above the glass transition temperature of the flame-spray deposited coating material. In still other cases, that elevated temperature is at or above the glass transition temperature of the color coat. Further cases provide that elevated temperature at or above the glass transition temperature of the ground coat, the flame-spray deposited coating material, and the color coat. Sometimes, the skilled artisan may prefer to use the annealing temperature range of one or more materials as a reference point. Accordingly, in some cases, that elevated temperature is at or above the annealing temperature range of the ground coat. In other cases, that elevated temperature is at or above the annealing temperature range of the flame-spray deposited coating material. In further cases, that elevated temperature is at or above the annealing temperature range of the color coat. In still other cases, that elevated temperature is at or above the annealing temperature ranges of the ground coat, the flame-spray deposited coating material, and the color coat.

The time it takes to cool the substrate slowly may depend on one or more factors, such as, for example, the size of the workpiece or the portion of the workpiece having new or repaired chemically-resistant coating, the mass and thickness of the coating, the geometry of the workpiece (substantially planar, concave, convex, or complex), and the physical properties of the substrate, ground coat, and coating material (glass transition temperature, coefficient of thermal expansion). In some embodiments, therefore, cooling the substrate slowly comprises allowing the substrate to pass through the glass transition temperature of the ground coat in a time period of not less than thirty minutes after the flame-spray depositing. Other embodiments allow the substrate to pass through the glass transition temperature of the coating material in a time period of not less than thirty minutes, not less than one hour, or not less than two hours after the flame-spray depositing.

Some embodiments of the present invention provide additional layers. For example, more than one ground coat can be applied before the flame-spray deposition. One or more intermediate coats can be included as well. More than one layer of flame-spray deposited coating materials also appear in certain embodiments. Such additional layers can comprise any suitable materials and exhibit any suitable characteristics. For example, in a few embodiments, the various layers of material have coefficients of thermal expansion such that each layer has a coefficient numerically between the adjacent materials, so that the overall coating performs adequately upon heating and cooling. It is possible in further embodiments that the flame-spray deposition occurs onto a layer of material that is in a softened or in a cooled state.

Some embodiments provide a different process in lieu of or in addition to flame-spray depositing known as hot dusting. In such embodiments, a subsequently-added material in particulate form is heated and dusted on the softened layer already on the substrate. This technique can be useful to create an alternative aesthetic effect when the color coat composition is added to the coating material already flame sprayed on the substrate and ground coat. Then the substrate is cooled slowly, as described elsewhere herein. Accordingly, some embodiments relate to methods for preparing or repairing a chemically-resistant coating on a substrate having a ground coat thereon, comprising: heating a substrate having a ground coat and a coating material thereon to a first temperature thereby forming a softened coating material; hot-dust depositing a color coat composition onto the softened coating material; and cooling the substrate slowly, thereby preparing or repairing the chemically-resistant coating on the substrate.

Testing the Chemically-Resistant Coating

Chemically-resistant coatings of the present invention can be characterized and distinguished from other coatings in numerous ways. To determine the identity and relative amount of the ingredients in a coating, any suitable method can be used. It is possible, in some circumstances, to employ energy-dispersive X-ray spectroscopy ("EDX"), X-ray fluorescence ("XRF"), various forms of electron microscopy, petrography, optical microscopy, and other analytical techniques to determine the identity and amount of components of a coating. In addition, it is possible to calculate the composition of a coating from the relative amounts of raw ingredients used to make the ground coat material, the frit, if any, of the ground coat material, the mill additions, if any, of the ground coat material, the frit, if any, of the coating material, the mill additions, if any, of the coating material, and any other ingredients. Two methods of such calculations may be mentioned, and both are fully explained in Chapter 6, Enamel Calculations, of the Andrews text. The first is the so-called "Factor Method," because it employs numerical factors for estimating the amount of material formed from a given raw material. For example, it is estimated that 1 gram of soda ash ($Na_2CO_3$) will yield 0.585 grams of sodium oxide ($Na_2O$) after firing, so the factor used to calculate the relative amount of sodium oxide in the final coating from the amount of soda ash added is 0.585. See Andrews, Table 23, page 218. The second is the so-called "Chemical Method," which relies on sorting the resulting oxides into basic oxides having the formula $R_2O$ or RO, intermediate oxides having the formula $R_2O_3$, and acidic oxides having the formula $RO_2$. See Andrews, page 230. Those methods are known to those having ordinary skill in the art, so are not further elucidated here.

The coefficients of thermal expansion of the substrate, ground coat, coating material, and color coat, can be any suitable values. For example, in one embodiment, the chemically-resistant coating has a coefficient of thermal expansion ranging from about 85 to about $89\times10^{-7}$ centimeters per centimeter per degree centigrade. In this embodiment, the substrate to be coated may be, e.g., a concave surface such as, e.g., the inside of a reactor vessel. In another embodiment, the chemically-resistant coating has a coefficient of thermal expansion ranging from about 100 to about $105\times10^{-7}$ centimeters per centimeter per degree centigrade. In this embodiment, the substrate to be coated may be a convex surface such as, e.g., the blade of an agitator. In still other embodiments, the substrate comprises low carbon steel, and has a coefficient of thermal expansion of about $125\times10^{-7}$ centimeters per centimeter per degree centigrade. An additional embodiment provides a ground coat having a coefficient of thermal expansion of about $100\times10^{-7}$ centimeters per centimeter per degree centigrade. Still another embodiment provides a coating material having a coefficient of thermal expansion of about $80\times10^{-7}$ centimeters per centimeter per degree centigrade.

The glass transition temperature of the coating, or of the ground coat, coating material, color coat, or any component thereof, can be measured using differential scanning calorimetry and thermal dilatometry, as is known in the art.

The acid resistance of the coated substrate may be tested in substantial accordance with the test described in U.S. Pat. No. 4,407,868. The standard test JIS R-4301 discussed in EXAMPLE 6 of such patent is substantially the same test as described in DIN 2743. The afore-mentioned Andrews text describes on page 586 the acid resistance test known as ASTM Desig. C 283-54 (1954). Such a test is also acceptable, as are any other suitable tests.

When the testing of the coated substrate is done in accordance with DIN 2743 and the substrate is exposed to a vapor of 20 volume percent of hydrochloric acid, the chemically-resistant coating may lose no more than about 0.3 grams per square meter per day, in some embodiments of the present invention.

The thermal shock properties of the chemically-resistant coating may be tested in accordance with A.S.T.M. Standard Test C385-58. An impact resistance test may be conducted with the apparatus illustrated in FIG. 3 of the '439 patent. An electrical test apparatus also may be utilized. The electrical test apparatus can be a 20,000 volt alternating current test spark tester supplied by the DeDietrich Co. of Corpus Christi, Tex. Using such an apparatus, a chemically-resistant coating of the present invention can be subject to a 20 KV spark test to evaluate the integrity of the coating. Different areas of the coating can be tested to measure the overall quality of the coating.

EXAMPLES

The following examples are presented to illustrate the claimed invention but are not to be deemed limitative thereof. Unless otherwise specified, all parts are by weight and all temperatures are in degrees Centigrade. The equipment, materials, volumes, weights, temperatures, sources of materials, manufacturers of equipment, and other parameters are offered to illustrate, but not to limit, the invention. All such parameters can be modified within the scope of the claimed invention.

Example 1

Ground Coat on a Steel Substrate

To a tumbling mill (such as those manufactured by the Curtis Manufacturing Company or U.S. Stoneware of East Palestine, Ohio) is charged 36.34 parts of feldspar (sold by the Pacer Corporation of Custer, S. Dak., as "Custer Feldspar"), 23.65 parts of dehydrated borax (sold by the U.S. Borax Corporation of Death Valley, Calif. as "anhydrous borax"), 2.16 parts of fluorspar (sold by READE Advanced Materials of East Providence, R.I. as "fluorspar powder"), 2.03 parts of potassium nitrate (sold by the Interstate Chemical Company of West Middlesex, Pa. as "potash niter"), 9.02 parts of sodium carbonate (sold by the Interstate Chemical Company as "soda ash"), 25.11 parts of quartz (sold by Short Mountain Silica of Mooresburg, Tenn. as "glass sand"), 0.85 parts of cobalt oxide (sold by Atlantic Equipment Engineers of Bergenfield, N.J. as "black cobalt oxide powder," Item # CO-601), 0.47 parts of nickel oxide (sold by Atlantic Equipment Engineers as "green nickel oxide powder," Item # NI-601), and 0.38 parts of manganese oxide (sold by Atlantic Equipment Engineers as "manganese dioxide powder," Item # MN-601). Thereafter, these reagents are mixed by tumbling them for two hours at a speed of 30 revolutions per minute.

The mixture thus produced is then charged to a 5200 mL cylindrical crucible comprised of 92 percent alumina; this crucible can be obtained from Antaeus Hi-Tech, Zhengzhou City, Henan Province, China. The crucible containing the glass batch is then charged to a Harper Furnace, model number H4S121412EKA30S (manufactured by the Harper Electric Furnace Corporation of Lancaster, N.Y.); both the crucible and the furnace are preheated to a temperature of 1,400 degrees Centigrade (2,552 degrees Fahrenheit) prior to the time the batch was charged to the crucible or placed into the furnace.

The glass batch is heated at 1,400 degrees Centigrade for 4.0 hours. At the end of this time, a fiber is pulled from the glass batch to check that the material is fully smelted and in solution. Thereafter, the material is poured from the crucible into a thirty-gallon quenching kettle at a temperature of 55 degrees Fahrenheit (12.8 degrees Centigrade) which is filled with 25 gallons of water, thereby quenching the molten glass.

Water is removed from the kettle, and the quenched frit is then dried in the kettle to a moisture content of less than 1.0 weight percent.

To a number 2 jar mill (manufactured by U.S. Stoneware Corporation) is charged 100 parts of the dried frit, 7 parts of OM4 ball clay (sold by Great Lakes Clay of Elgin, Ill.), 40 parts of number 3 glass sand, 0.155 parts of sodium nitrite (sold by the Interstate Chemical Corporation as sodium nitrite), 0.155 parts of anhydrous borax, and 44 parts of deionized water. The total weight of the charge to the jar mill, dry basis, is 3,234 grams; the grinding media used is 6,600 grams of 1.25 inch high-density alumina balls and 3,300 grams of 1.0 inch high-density alumina balls. The mixture is then milled at a rate of 34 revolutions per minute for two hours.

The slurry thus produced is checked for particle size distribution by passing it through a series of 100 mesh Tyler and 325 mesh Tyler steel sieves; milling is continued until 20 weight percent of the particles in the slurry are retained on the 100 mesh sieve, and 75 percent of the particles are retained on the 325 mesh sieve.

Deionized water is added to the slurry until its specific gravity was 1.78. Thereafter, the slurry is placed into a DeVilbiss JGV560 Spray Gun (manufactured by the DeVilbiss Company of Toledo, Ohio).

A 6"×6"×0.5" thick steel plate (SA285, Grade B steel, such as is available from the Nucor Corporation of Charlotte, N.C.) is used as the substrate for the ground coat composition. Before deposition, the plate is grit blasted with minus 40 mesh alumina at 80 pounds per square inch until a clean sample is obtained. Thereafter, the clean sample is sprayed with the ground coat slurry material until a wet film with a wet film thickness of 0.62 millimeters is obtained. The coated substrate is then allowed to air dry under ambient conditions for 2.0 hours.

The dried plate is then charged to Cooley BL4 Electric Furnace which is preheated to a temperature of 870 degrees Centigrade. The plate is subjected to this temperature for a period of 40 minutes.

Example 2

Preparing Coating Material

The coating material is prepared as follows. To the aforementioned tumbling mill is charged 9.09 parts of the aforementioned feldspar, 1.52 parts of calcium carbonate (sold by Interstate Chemical Company), 3.57 parts of magnesium carbonate (sold by American Elements of Los Angeles, Calif., as magnesium carbonate), 4.24 parts of potassium nitrite (sold by Interstate Chemical Company as potassium nitrite), 5.00 of sodium nitrate (sold by American Elements as sodium nitrate), 16.79 parts of the aforementioned sodium carbonate, 5.9 parts of zirconium silicate (sold by the Tam Ceramic Products Corporation of Niagara Falls, N.Y. as "Zircosil"), 2.17 parts of the aforementioned anhydrous borax, 4.2 parts of lithium carbonate (sold by American Elements as lithium carbonate), and 62.18 parts of the aforementioned quartz. The mixture is then mixed for 2.0 hours at a speed of 30 revolutions per minute.

The mixture thus produced is charged to a crucible comprised of 92 percent alumina; this crucible can be obtained from Antaeus Hi-Tech, Zhengzhou City, Henan Province, China. The crucible containing the glass batch is then charged to a Harper Furnace, model number H4S121412EKA30S (manufactured by the Harper Electric Furnace Corporation of Lancaster, N.Y.); both the crucible and the furnace are preheated to a temperature of 1,400 degrees Centigrade prior to the time the batch is charged to the crucible or placed into the furnace.

The glass batch is heated at 1,400 degrees Centigrade for 4.0 hours. At the end of this time, a fiber is pulled from the glass batch to check that the material is fully smelted and in solution. Thereafter, the material is poured from the crucible into a thirty-gallon quenching kettle at a temperature of 55 degrees Fahrenheit which is filled with 25 gallons of water, thereby quenching the molten glass. Water is removed from the kettle, and the quenched frit is then dried in the kettle to a moisture content of less than 1.0 weight percent.

To a number 2 jar mill (manufactured by U.S. Stoneware Corporation) is charged 100 parts of the dried frit, 0.62 parts of purified Wyoming bentonite (sold by Wyo-Ben, Inc., of Billings, Mont.), 0.62 parts of potassium chloride (sold by Interstate Chemical Company as potassium chloride), and 35 parts of deionized water. The total weight of the charge to the jar mill, dry basis, is 2,334.8 grams; the grinding media used is 6,600 grams of 1.25 inch high-density alumina balls and 3,300 grams of 1.0 inch high-density alumina balls. The mixture is then milled at a rate of 34 revolutions per minute for two hours.

The mixture thus produced is charged to a crucible comprised of 90 percent alumina as described above; this crucible is then charged to the Harper Furnace. Both the crucible and the furnace are preheated to a temperature of 1,400 degrees Centigrade prior to the time the batch is charged to the crucible or placed into the furnace.

The mixture is heated at 1,400 degrees Centigrade for 4.0 hours. At the end of this time, a fiber is pulled to check that the material is fully smelted and in solution. Thereafter, the now-formed coating material is poured from the crucible into a thirty-gallon quenching kettle at a temperature of 55 degrees Fahrenheit which is filled with 25 gallons of water, thereby quenching the molten coating material. Water is removed from the kettle, and the quenched coating material is then dried in the kettle to a moisture content of less than 1.0 weight percent.

The coating material thus produced is returned to the jar mill and milled until an appropriate particle size distribution results. The coating material is checked for particle size distribution by passing it through a series of 100 mesh Tyler and 325 mesh Tyler steel sieves; milling continues until 10 weight percent of the particles are retained on the 100 mesh sieve, and 80 percent of the particles are retained on the 325 mesh sieve. Alternatively, particles having a size distribution ranging from about 115 micrometers to about 125 micrometers can be chosen through selective use of appropriate sieves.

Example 3

Coating Material Flame-Spray Deposited onto the Cooled Ground Coat

The coating material particles are loaded into a flame sprayer, and flame-spray deposited on the substrate. The aforementioned, ground-coated 6"×6"×0.5" thick steel plate with the ground coat thereon was used as the target. The steel plate is removed from the electric furnace and allowed to cool to ambient temperature. Optionally, an induction coil causes the substrate to cool more slowly, reducing stress in the ground coat. A suitable temperature detection device, such as a thermocouple or an infrared laser temperature detector, may monitor the temperature. The flame sprayer deposits the coating material onto the cooled ground coat. The temperature of coating material leaving the flame sprayer is about 6,000 degrees Fahrenheit. Additional layers of various alike or different compositions can be added, optionally while the coating material remains in a softened state.

Then the substrate is allowed to cool, by exposure to ambient air or optionally by the application of an induction coil to slowly cool the substrate. After two hours, the substrate cools below the glass transition temperature of the coating material. The substrate is then allowed to cool to room temperature at a rate of about 120 degrees Fahrenheit per hour.

Example 4

Adding Color Coat

When the substrate from Example 3 has reached a temperature no greater than about 150 degrees Fahrenheit, a color coat composition is added. A color coat composition, prepared as the coating material above, further contains 1.0 part of the aforementioned cobalt oxide, and 1.2 parts of black iron oxide (sold by Atlantic Equipment Engineers as "black iron oxide (magnetite)," Item # FE-602) charged into the tumbling mill with the feldspar, etc. Optionally, no bentonite or other clay is introduced into the coating material above; instead, it can be introduced into the color coat composition when the dried frit is added to the jar mill. Once the color coat composition is reduced to a desired particle size, an aqueous slurry is formed, and the color coat composition in slurry form is sprayed onto the target using a standard paint spray gun. The slurry is allowed to air dry under ambient conditions for 2.0 hours. Then, an induction heater heats the substrate to a temperature ranging from about 1,300 to about 1,410 degrees Fahrenheit. The substrate is allowed to cool slowly by application of an induction heater, at a rate of 2 degrees Fahrenheit per minute to an intermediate temperature ranging from about 750 to about 800 degrees Fahrenheit. From the intermediate temperature the substrate is allowed to cool to ambient temperature by exposure to ambient air. The resulting chemically-resistant coating on the steel substrate is ready for testing.

Example 5

Testing the Chemically-Resistant Coating

The coated steel plate from Example 4 is checked for electrical conductivity using the 20,000 volt test procedure; the plate should be an effective insulator.

The coating thickness is measured by a Fisher Deltascope thickness meter, and the mean thickness likely ranges from about 1.28 to about 1.52 millimeters; 32 readings are taken.

The sample is tested in accordance with the impact resistance test described in the specification of the '439 patent. Following each impact, the sample is tested by the aforementioned Electric Spark Test, using 20,000 volts.

Example 6

Convex Substrate

In substantial accordance with the procedure of Examples 1-4, a coated substrate is prepared, with the exceptions that (1) the target used is a convex-shaped steel substrate (SA-285), (2) the coating material is made from a glass batch which comprised 2.3 parts of potassium oxide, 15.3 parts of sodium oxide, 4.0 parts of barium oxide, 1.0 parts of calcium oxide, 1.3 parts of zinc oxide, 2.6 parts of lithium oxide, 69.8 parts of silica, and 3.7 parts of alumina. The coated and fired substrate should have properties comparable to the coated substrate of Example 4.

VARIOUS EMBODIMENTS

Embodiment 1

A method for preparing a chemically-resistant coating on a substrate having a ground coat thereon, the substrate having an initial temperature substantially near ambient temperature, comprising:

flame-spray depositing a coating material onto the ground coat;

optionally heating the substrate; and cooling the substrate slowly, thereby forming the chemically-resistant coating on the substrate.

Embodiment 2

The method of embodiment 1, wherein the substrate comprises steel.

Embodiment 3

The method of any one of embodiments 1-2, wherein the ground coat comprises from about 60 to about 65 weight percent of silica.

Embodiment 4

The method of any one of embodiments 1-3, wherein the ground coat comprises from about 10 to about 22 weight percent of boric oxide.

Embodiment 5

The method of any one of embodiments 1-4, wherein the ground coat comprises from about 1 to about 9 weight percent of potassium oxide.

Embodiment 6

The method of any one of embodiments 1-5, wherein the ground coat comprises from about 1 to about 9 weight percent of alumina.

Embodiment 7

The method of any one of embodiments 1-6, wherein the ground coat comprises calcium oxide, cobalt oxide, nickel oxide, manganese oxide, one or more alkali metal oxides, or a combination thereof.

Embodiment 8

The method of any one of embodiments 1-7, wherein the coating material comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide.

Embodiment 9

The method of any one of embodiments 1-8, wherein the coating material comprises from about 68 to about 74 weight percent of silica.

Embodiment 10

The method of any one of embodiments 1-9, wherein the coating material comprises from about 0.5 to about 2.5 weight percent of alumina.

Embodiment 11

The method of any one of embodiments 1-10, wherein the coating material comprises from about 7 to about 15 weight percent of sodium oxide.

Embodiment 12

The method of any one of embodiments 1-11, wherein the coating material comprises from about 1 to about 5 weight percent of lithium oxide.

Embodiment 13

The method of any one of embodiments 1-12, wherein the coating material comprises from about 2 to about 9 weight percent of zirconium oxide.

Embodiment 14

The method of any one of embodiments 1-13, wherein the initial temperature is no more than about 10° C. above the ambient temperature.

Embodiment 15

The method of any one of embodiments 1-14, wherein the initial temperature is no more than about 20° C. above the ambient temperature.

Embodiment 16

The method of any one of embodiments 1-15, wherein the initial temperature is no more than about 100° C. above the ambient temperature.

Embodiment 17

The method of any one of embodiments 1-16, wherein cooling the substrate slowly comprises applying induction heating.

Embodiment 18

The method of any one of embodiments 1-17, wherein cooling the substrate slowly comprises allowing the substrate to pass through the glass transition temperature of the ground coat in a time period of not less than thirty minutes after the flame-spray depositing.

Embodiment 19

The method of any one of embodiments 1-18, wherein cooling the substrate slowly comprises allowing the substrate to pass through the glass transition temperature of the coating material in a time period of not less than thirty minutes after the flame-spray depositing.

Embodiment 20

The method of any one of embodiments 1-19, wherein cooling the substrate slowly comprises allowing the substrate to pass through the glass transition temperature of the coating material in a time period of not less than one hour after the flame-spray depositing.

Embodiment 21

The method of any one of embodiments 1-20, wherein cooling the substrate slowly comprises allowing the substrate to pass through the glass transition temperature of the coating material in a time period of not less than two hours after the flame-spray depositing.

Embodiment 22

The method of any one of embodiments 1-21, wherein the chemically-resistant coating has a thickness of 40-60 mils.

Embodiment 23

The method of any one of embodiments 1-22, wherein the coating material contains substantially no suspending agents or pigments.

Embodiment 24

The method of any one of embodiments 1-23, wherein the coating material contains substantially no clay.

Embodiment 25

The method of any one of embodiments 1-24, further comprising
after cooling the substrate slowly,
applying a color coat composition to the coating material on the substrate;
optionally further heating the substrate; and
further cooling the substrate slowly,
thereby forming the chemically-resistant coating.

Embodiment 26

The method of embodiment 25, wherein the color coat has a thickness ranging from about 10 mils to about 15 mils.

Embodiment 27

The method of any one of embodiments 25-26, wherein the color coat composition is applied by spraying.

Embodiment 28

The method of any one of embodiments 25-27, wherein optionally further heating the substrate comprises applying induction heating to the substrate.

Embodiment 29

The method of any one of embodiments 25-28, wherein optionally further heating the substrate comprises heating the substrate to a temperature ranging from about 1,300 degrees Fahrenheit to about 1,410 degrees Fahrenheit.

Embodiment 30

The method of any one of embodiments 25-29, wherein optionally further heating the substrate comprises heating the substrate to a temperature ranging from about 1,350 degrees Fahrenheit to about 1,400 degrees Fahrenheit.

Embodiment 31

The method of any one of embodiments 25-30, wherein further cooling the substrate slowly comprises applying induction heating to the substrate.

Embodiment 32

The method of any one of embodiments 25-31, wherein further cooling the substrate slowly comprises cooling the substrate at a rate of about 2 degrees Fahrenheit per minute.

Embodiment 33

The method of any one of embodiments 25-32, wherein further cooling the substrate slowly comprises cooling the substrate from a high temperature of about 1,350-1,400 degrees Fahrenheit to an intermediate temperature of about 750-800 degrees Fahrenheit; and
allowing the substrate to cool from the intermediate temperature in the absence of heating.

Embodiment 34

The method of any one of embodiments 25-33, wherein the thickness of the chemically-resistant coating ranges from about 75 mils to about 80 mils.

Embodiment 35

The method of any one of embodiments 25-34, wherein the color coat composition comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide, and further comprises at least one pigment.

Embodiment 36

The method of any one of embodiments 1-35, wherein the thickness of the chemically-resistant coating ranges from about 40 mils to about 60 mils.

Embodiment 37

The method of any one of embodiments 1-36, wherein the initial temperature is about 75 degrees Fahrenheit.

Embodiment 38

The method of any one of embodiments 1-37, wherein the initial temperature ranges from about 50 degrees Fahrenheit to about 90 degrees Fahrenheit.

Embodiment 39

The method of any one of embodiments 1-38, wherein the initial temperature is no more than about 150 degrees Fahrenheit.

Embodiment 40

A method of repairing a chemically-resistant coating on a substrate in need thereof, the substrate having an initial temperature substantially near ambient temperature, comprising:

applying a composition to a damage site on the substrate, wherein the composition:

(a) comprises a ground coat material in the form of particles having a particle size distribution such that at least about 5 weight percent of the particles are smaller than 44 micrometers and at least about 20 weight percent of the particles are larger than 150 micrometers, and (b) the ground coat material comprises a frit material comprising from about 48 to about 58 weight percent of silica, from about 12 to about 22 weight percent of boric oxide, from about 1 to about 9 weight percent of potassium oxide, and from about 1 to about 9 weight percent of alumina;

firing the composition to form a softened ground coat on the substrate;

allowing the softened ground coat to cool to substantially near ambient temperature, forming a cooled ground coat;

flame-spray depositing a coating material onto the cooled ground coat, wherein the coating material:

(a) is in the form of particles having an average size ranging from about 74 to about 177 micrometers, and (b) comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide; and cooling the substrate slowly, thereby repairing the chemically-resistant coating on the substrate.

Embodiment 41

The method of embodiment 40, wherein the firing comprises applying induction heating.

Embodiment 42

The method of any one of embodiments 40-41, wherein allowing the softened ground coat to cool to substantially near ambient temperature comprises applying induction heating.

Embodiment 43

The method of any one of embodiments 40-42, wherein allowing the softened ground coat to cool to substantially near ambient temperature comprises applying induction heating to the substrate as the substrate cools from a high temperature of about 1,450 to about 1500 degrees Fahrenheit.

Embodiment 44

The method of any one of embodiments 40-43, wherein allowing the softened ground coat to cool to substantially near ambient temperature comprises applying induction heating to the substrate so the substrate cools at a rate of about 2° F. per minute.

Embodiment 45

The method of any one of embodiments 40-44, wherein cooling the substrate slowly comprises applying induction heating.

Embodiment 46

The method of any one of embodiments 40-45, wherein cooling the substrate slowly comprises allowing the substrate to pass through the glass transition temperature of the coating material in a time period of not less than thirty minutes after the flame-spray depositing.

Embodiment 47

The method of any one of embodiments 40-46, wherein cooling the substrate slowly comprises allowing the substrate to pass through the glass transition temperature of the coating material in a time period of not less than one hour after the flame-spray depositing.

Embodiment 48

The method of any one of embodiments 40-47, wherein cooling the substrate slowly comprises allowing the substrate to pass through the glass transition temperature of the coating material in a time period of not less than two hours after the flame-spray depositing.

Embodiment 49

The method of any one of embodiments 40-48, wherein cooling the substrate slowly comprises applying induction heating to the substrate as the substrate cools from a high temperature of about 1,350 to about 1,400 degrees Fahrenheit to an intermediate temperature of about 750-800 degrees Fahrenheit at a rate of about 2° F. per minute; and allowing the substrate to cool from the intermediate temperature to the ambient temperature in the absence of induction heating.

Embodiment 50

The method of any one of embodiments 40-49, wherein the composition is in the form of a slurry and comprises from about 30 to about 40 weight percent liquid.

Embodiment 51

The method of embodiment 50, wherein the liquid comprises water.

Embodiment 52

The method of any one of embodiments 40-51, further comprising drying the composition before the firing.

Embodiment 53

The method of any one of embodiments 40-52, wherein the coating material in the form of particles has an average size ranging from about 115 to about 125 micrometers.

Embodiment 54

The method of any one of embodiments 40-53, further comprising cleaning the damage site before applying the composition.

Embodiment 55

The method of embodiment 54, wherein the cleaning comprises sand blasting, grit blasting, or a combination of both.

Embodiment 56

The method of any one of embodiments 40-55, wherein the frit material further comprises calcium oxide, cobalt oxide, nickel oxide, manganese oxide, lithium oxide, sodium oxide, rubidium oxide, cesium oxide, francium oxide, or a combination thereof.

Embodiment 57

The method of any one of embodiments 40-56, further comprising:
after cooling the substrate slowly,
applying a color coat composition to the coating material on the substrate;
optionally further heating the substrate; and
further cooling the substrate slowly,
thereby repairing the chemically-resistant coating on the substrate.

Embodiment 58

The method of embodiment 57, wherein the color coat composition comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide, and further comprises at least one pigment.

Embodiment 59

The method of any one of embodiments 57-58, wherein the color coat has a thickness ranging from about 10 mils to about 15 mils.

Embodiment 60

The method of any one of embodiments 57-59, wherein the color coat composition is applied by spraying.

Embodiment 61

The method of any one of embodiments 57-60, wherein optionally further heating the substrate comprises applying induction heating to the substrate.

Embodiment 62

The method of any one of embodiments 57-61, wherein optionally further heating the substrate comprises heating the substrate to a temperature ranging from about 1,300 degrees Fahrenheit to about 1,410 degrees Fahrenheit.

Embodiment 63

The method of any one of embodiments 57-62, wherein optionally further heating the substrate comprises heating the substrate to a temperature ranging from about 1,350 degrees Fahrenheit to about 1,400 degrees Fahrenheit.

Embodiment 64

The method of any one of embodiments 57-63, wherein further cooling the substrate slowly comprises applying induction heating to the substrate.

Embodiment 65

The method of any one of embodiments 57-64, wherein further cooling the substrate slowly comprises cooling the substrate at a rate of about 2 degrees Fahrenheit per minute.

Embodiment 66

The method of any one of embodiments 57-65, wherein further cooling the substrate slowly comprises cooling the substrate from a high temperature of about 1,350-1,400 degrees Fahrenheit to an intermediate temperature of about 750-800 degrees Fahrenheit; and
allowing the substrate to cool from the intermediate temperature in the absence of heating.

Embodiment 67

A method of preparing a chemically-resistant coating on a substrate, comprising:
applying a composition to the substrate, wherein the composition:
(a) comprises a ground coat material in the form of particles having a particle size distribution such that at least about 5 weight percent of the particles are smaller than 44 micrometers and at least about 20 weight percent of the particles are larger than 150 micrometers, and (b) the ground coat material comprises a frit material comprising from about 48 to about 58 weight percent of silica, from about 12 to about 22 weight percent of boric oxide, from about 1 to about 9 weight percent of potassium oxide, and from about 1 to about 9 weight percent of alumina;

firing the composition to form a softened ground coat on the substrate;

allowing the softened ground coat to cool to substantially near ambient temperature, forming a cooled ground coat;

flame-spray depositing a coating material onto the cooled ground coat, wherein the coating material:

(a) is in the form of particles having an average size ranging from about 74 to about 177 micrometers, and (b) comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide; and cooling the substrate slowly, thereby preparing the chemically-resistant coating on the substrate.

Embodiment 68

The method of embodiment 67, wherein the firing comprises applying induction heating.

Embodiment 69

The method of any one of embodiments 67-68, wherein the allowing the softened ground coat to cool to substantially near ambient temperature comprises applying induction heating.

Embodiment 70

The method of any one of embodiments 67-69, wherein the allowing the softened ground coat to cool to substantially near ambient temperature comprises applying induction heating to the substrate as the substrate cools from a high temperature of about 1450-1500° F.

Embodiment 71

The method of any one of embodiments 67-70, wherein the allowing the softened ground coat to cool to substantially near ambient temperature comprises applying induction heating to the substrate so the substrate cools at a rate of about 2° F. per minute.

Embodiment 72

The method of any one of embodiments 67-71, wherein the cooling the substrate slowly comprises applying induction heating.

Embodiment 73

The method of any one of embodiments 67-72, wherein cooling the substrate slowly comprises allowing the substrate to pass through the glass transition temperature of the coating material in a time period of not less than thirty minutes after the flame-spray depositing.

Embodiment 74

The method of any one of embodiments 67-73, wherein cooling the substrate slowly comprises allowing the substrate to pass through the glass transition temperature of the coating material in a time period of not less than one hour after the flame-spray depositing.

Embodiment 75

The method of any one of embodiments 67-74, wherein cooling the substrate slowly comprises allowing the substrate to pass through the glass transition temperature of the coating material in a time period of not less than two hours after the flame-spray depositing.

Embodiment 76

The method of any one of embodiments 67-75, wherein the composition is in the form of a slurry and comprises from about 30 to about 40 weight percent liquid.

Embodiment 77

The method of any one of embodiments 67-76, wherein the liquid comprises water.

Embodiment 78

The method of any one of embodiments 67-77, further comprising drying the composition before the firing.

Embodiment 79

The method of any one of embodiments 67-78, wherein the coating material in the form of particles has an average size ranging from about 115 to about 125 micrometers.

Embodiment 80

The method of any one of embodiments 67-79, further comprising cleaning the substrate before applying the composition.

Embodiment 81

The method of embodiment 80, wherein the cleaning comprises sand blasting, grit blasting, or a combination of both.

Embodiment 82

The method of any one of embodiments 67-81, wherein the frit material further comprises calcium oxide, cobalt oxide, nickel oxide, manganese oxide, lithium oxide, sodium oxide, rubidium oxide, cesium oxide, francium oxide, or a combination thereof.

Embodiment 83

The method of any one of embodiments 67-82, further comprising:

after cooling the substrate slowly, applying a color coat composition to the coating material on the substrate;

optionally further heating the substrate; and further cooling the substrate slowly, thereby repairing the chemically-resistant coating on the substrate.

Embodiment 84

The method of embodiment 83, wherein the color coat composition comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide, and further comprises at least one pigment.

Embodiment 85

The method of any one of embodiments 83-84, wherein the color coat has a thickness ranging from about 10 mils to about 15 mils.

Embodiment 86

The method of any one of embodiments 83-85, wherein the color coat composition is applied by spraying.

Embodiment 87

The method of any one of embodiments 83-86, wherein optionally further heating the substrate comprises applying induction heating to the substrate.

Embodiment 88

The method of any one of embodiments 83-87, wherein optionally further heating the substrate comprises heating the substrate to a temperature ranging from about 1,300 degrees Fahrenheit to about 1,410 degrees Fahrenheit.

Embodiment 89

The method of any one of embodiments 83-88, wherein optionally further heating the substrate comprises heating the substrate to a temperature ranging from about 1,350 degrees Fahrenheit to about 1,400 degrees Fahrenheit.

Embodiment 90

The method of any one of embodiments 83-89, wherein further cooling the substrate slowly comprises applying induction heating to the substrate.

Embodiment 91

The method of any one of embodiments 83-90, wherein further cooling the substrate slowly comprises cooling the substrate at a rate of about 2 degrees Fahrenheit per minute.

Embodiment 92

The method of any one of embodiments 83-91, wherein further cooling the substrate slowly comprises cooling the substrate from a high temperature of about 1,350-1,400 degrees Fahrenheit to an intermediate temperature of about 750-800 degrees Fahrenheit; and allowing the substrate to cool from the intermediate temperature in the absence of heating.

Embodiment 93

The method of any one of embodiments 1-39, wherein the coating material comprises a material in the form of particles having an average particle size ranging from about 50 to about 100 micrometers.

Embodiment 94

The method of any one of embodiments 1-39, wherein the coating material comprises a material in the form of particles having an average particle size ranging from about 100 to about 150 micrometers.

Embodiment 95

The method of any one of embodiments 1-39, wherein the coating material comprises a material in the form of particles having an average particle size ranging from about 150 to about 200 micrometers.

Embodiment 96

The method of any one of embodiments 1-39, wherein the coating material comprises a material in the form of particles having an average particle size ranging from about 200 to about 250 micrometers.

Embodiment 97

The method of any one of embodiments 1-39, wherein the coating material comprises a material in the form of particles having an average particle size ranging from about 250 to about 300 micrometers.

Embodiment 98

The method of any one of embodiments 1-39, wherein the coating material comprises a material in the form of particles having an average particle size ranging from about 300 to about 350 micrometers.

Embodiment 99

The method of any one of embodiments 1-39, wherein the coating material comprises a material in the form of particles having an average particle size ranging from about 350 to about 400 micrometers.

Embodiment 100

An article comprising:

(a) a metal substrate;

(b) a ground coat comprising silica, boric oxide, potassium oxide, and alumina;

(c) a coating in the form of splats comprising silica, alumina, sodium oxide, lithium oxide, and zirconium oxide; and (d) a color coat comprising at least one pigment.

Embodiment 101

The article of embodiment 100, wherein the metal substrate comprises steel.

Embodiment 102

The article of any one of embodiments 100-101, wherein the splats have an average volume ranging from about $2.1\times10^{-13}$ $m^3$ to about $2.9\times10^{-12}$ $m^3$.

Embodiment 103

The article of any one of embodiments 100-102, wherein the splats have an average volume ranging from about $2.1\times10^{-13}$ $m^3$ to about $1.7\times10^{-12}$ $m^3$.

Embodiment 104

The article of any one of embodiments 100-103, wherein the splats have an average volume ranging from about $7.9\times10^{-13}$ $m^3$ to about $1.0\times10^{-12}$ $m^3$.

Embodiment 105

The article of any one of embodiments 100-104, wherein the article is a reactor vessel.

Embodiment 106

The article of any one of embodiments 100-104, wherein the article is a cover.

Embodiment 107

The article of any one of embodiments 100-104, wherein the article is a baffle.

Embodiment 108

The article of any one of embodiments 100-104, wherein the article is a thermowell.

Embodiment 109

The article of any one of embodiments 100-104, wherein the article is an agitator.

Embodiment 110

The article of any one of embodiments 100-104, wherein the article is an agitator shaft.

Embodiment 111

The article of any one of embodiments 100-104, wherein the article is a pipe.

Embodiment 112

The article of any one of embodiments 100-104, wherein the article is a heat exchanger.

Embodiment 113

The article of any one of embodiments 100-104, wherein the article is a storage tank.

Embodiment 114

The article of any one of embodiments 100-104, wherein the article is a dishwasher.

Embodiment 115

The article of any one of embodiments 100-104, wherein the article is a clothes washer.

Embodiment 116

The article of any one of embodiments 100-104, wherein the article is a clothes drier.

Embodiment 117

The article of any one of embodiments 100-104, wherein the article is an oven.

Embodiment 118

The article of any one of embodiments 100-104, wherein the article is a stove.

Embodiment 119

The article of any one of embodiments 100-104, wherein the article is a bathtub.

Embodiment 120

The article of any one of embodiments 100-104, wherein the article is a shower stall.

Embodiment 121

The article of any one of embodiments 100-104, wherein the article is a sink.

Embodiment 122

The article of any one of embodiments 100-104, wherein the article is a steel girder.

Embodiment 123

The article of any one of embodiments 100-104, wherein the article is a steel reinforcing bar.

Embodiment 124

The article of any one of embodiments 100-123, wherein the ground coat comprises from about 60 to about 65 weight percent of silica.

Embodiment 125

The article of any one of embodiments 100-124, wherein the ground coat comprises from about 10 to about 22 weight percent of boric oxide.

Embodiment 126

The article of any one of embodiments 100-125, wherein the ground coat comprises from about 1 to about 9 weight percent of potassium oxide.

Embodiment 127

The article of any one of embodiments 100-126, wherein the ground coat comprises from about 1 to about 9 weight percent of alumina.

Embodiment 128

The article of any one of embodiments 100-127, wherein the ground coat comprises calcium oxide, cobalt oxide, nickel oxide, manganese oxide, one or more alkali metal oxides in addition to potassium oxide, or a combination thereof.

Embodiment 129

The article of any one of embodiments 100-128, wherein the coating in the form of splats comprises from about 68 to about 74 weight percent of silica.

Embodiment 130

The article of any one of embodiments 100-129, wherein the coating in the form of splats comprises from about 0.5 to about 2.5 weight percent of alumina.

Embodiment 131

The article of any one of embodiments 100-130, wherein the coating in the form of splats comprises from about 7 to about 15 weight percent of sodium oxide.

Embodiment 132

The article of any one of embodiments 100-131, wherein the coating in the form of splats comprises from about 1 to about 5 weight percent of lithium oxide.

Embodiment 133

The article of any one of embodiments 100-132, wherein the coating in the form of splats comprises from about 2 to about 9 weight percent of zirconium oxide.

As previously stated, detailed embodiments of the present invention are disclosed herein; however, it is to be understood that the disclosed embodiments are merely exemplary of the invention that may be embodied in various forms. It will be appreciated that many modifications and other variations are within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

We claim:

1. A method of repairing a chemically-resistant coating on a substrate in need thereof, the substrate having an initial temperature substantially near ambient temperature, comprising:

applying a composition to a damage site on the substrate, wherein the composition:

(a) comprises a ground coat material in the form of particles having a particle size distribution such that at least about 5 weight percent of the particles are smaller than 44 micrometers and at least about 20 weight percent of the particles are larger than 150 micrometers, and (b) the ground coat material comprises a frit material comprising from about 48 to about 58 weight percent of silica, from about 12 to about 22 weight percent of boric oxide, from about 1 to about 9 weight percent of potassium oxide, and from about 1 to about 9 weight percent of alumina;

firing the composition to form a softened ground coat on the substrate;

allowing the softened ground coat to cool to substantially near ambient temperature by applying induction heating, forming a cooled ground coat;

flame-spray depositing a coating material onto the cooled ground coat, wherein the coating material:

(a) is in the form of particles having an average size ranging from about 74 to about 177 micrometers, and (b) comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide; and cooling the substrate slowly, thereby repairing the chemically-resistant coating on the substrate.

2. The method of claim 1, wherein the firing comprises applying induction heating.

3. The method of claim 1, wherein allowing the softened ground coat to cool to substantially near ambient temperature comprises applying induction heating to the substrate as the substrate cools from a high temperature of about 1,450 to about 1500 degrees Fahrenheit.

4. The method of claim 1, wherein allowing the softened ground coat to cool to substantially near ambient temperature comprises applying induction heating to the substrate so the substrate cools at a rate of about 2° F. per minute.

5. The method of claim 1, wherein cooling the substrate slowly comprises applying induction heating.

6. The method of claim 1, wherein cooling the substrate slowly comprises allowing the substrate to pass through the glass transition temperature of the coating material in a time period of not less than thirty minutes after the flame-spray depositing.

7. The method of claim 1, wherein cooling the substrate slowly comprises allowing the substrate to pass through the glass transition temperature of the coating material in a time period of not less than one hour after the flame-spray depositing.

8. The method of claim 1, wherein cooling the substrate slowly comprises allowing the substrate to pass through the glass transition temperature of the coating material in a time period of not less than two hours after the flame-spray depositing.

9. The method of claim 1, wherein cooling the substrate slowly comprises applying induction heating to the substrate as the substrate cools from a high temperature of about 1,350 to about 1,400 degrees Fahrenheit to an intermediate temperature of about 750-800 degrees Fahrenheit at a rate of about 2° F. per minute; and allowing the substrate to cool from the intermediate temperature to the ambient temperature in the absence of induction heating.

10. The method of claim 1, wherein the composition is in the form of a slurry and comprises from about 30 to about 40 weight percent liquid.

11. The method of claim 10, wherein the liquid comprises water.

12. The method of claim 1, further comprising drying the composition before the firing.

13. The method of claim 1, wherein the coating material in the form of particles has an average size ranging from about 115 to about 125 micrometers.

14. The method of claim 1, further comprising cleaning the damage site before applying the composition.

15. The method of claim 14, wherein the cleaning comprises sand blasting, grit blasting, or a combination of both.

16. The method of claim 1, wherein the frit material further comprises calcium oxide, cobalt oxide, nickel oxide, manganese oxide, lithium oxide, sodium oxide, rubidium oxide, cesium oxide, francium oxide, or a combination thereof.

17. The method of claim 1, further comprising:

after cooling the substrate slowly, applying a color coat composition to the coating material on the substrate;

optionally further heating the substrate; and further cooling the substrate slowly, thereby repairing the chemically-resistant coating on the substrate.

18. The method of claim 17, wherein the color coat composition comprises from about 68 to about 74 weight percent of silica, from about 0.5 to about 2.5 weight percent of alumina, from about 7 to about 15 weight percent of sodium oxide, from about 1 to about 5 weight percent of lithium oxide, and from about 2 to about 9 weight percent of zirconium oxide, and further comprises at least one pigment.

19. The method of claim 17, wherein the color coat has a thickness ranging from about 10 mils to about 15 mils.

* * * * *